US005566902A

United States Patent [19]

Thom, Jr.

[11] Patent Number: 5,566,902

[45] Date of Patent: Oct. 22, 1996

[54] ROLL ARRANGEMENT FOR A MILLING MACHINE, AND AN INTER-ROLL DRIVE THEREFOR

[75] Inventor: Kelsey C. Thom, Jr., Cedar Falls, Iowa

[73] Assignee: California Pellet Mill Company, San Francisco, Calif.

[21] Appl. No.: 440,149

[22] Filed: May 12, 1995

[51] Int. Cl.[6] ..... B02C 4/02; B02C 4/42

[52] U.S. Cl. ..... 241/227; 241/234

[58] Field of Search ..... 241/227, 230, 241/234

[56] References Cited

U.S. PATENT DOCUMENTS

| | | | |
|---|---|---|---|
| 2,481,201 | 9/1949 | Collier | 241/234 X |
| 2,655,815 | 10/1953 | McClelland | 241/227 X |
| 2,986,348 | 5/1961 | Noll et al. | 241/227 X |
| 3,412,769 | 11/1968 | Howard | 241/227 X |
| 3,700,182 | 10/1972 | Dediemar et al. | 241/230 |
| 3,881,663 | 5/1975 | Brown | 241/225 |
| 4,545,541 | 10/1985 | Jensen | 241/145 |
| 5,072,887 | 12/1991 | Thom, Jr. | 241/37 |

*Primary Examiner*—John M. Husar
*Attorney, Agent, or Firm*—Michael H. Minns

[57] ABSTRACT

A roll arrangement, for milling machine, comprising: a frame; a first elongated roll rotatably mounted within the frame, the first roll having a first end and a second end, the first roll having first sheaves attached at each end; a second elongated roll rotatably mounted within the frame, the second roll having a first end and a second end, the second roll having second sheaves attached at each end; a first belted drive means coupled to the first and second roll first ends; and a second belted drive means coupled to the first and second roll second ends.

9 Claims, 7 Drawing Sheets

ROLL ARRANGEMENT FOR A MILLING MACHINE, AND AN INTER-ROLL DRIVE THEREFOR

BACKGROUND OF THE INVENTION

This invention pertains to milling machines, in general, such as are used to mill or grind material, the same having inter-engaging rolls, and in particular to a roll arrangement, and an inter-roll drive, for a milling machine.

Known roll milling machines typically incorporate a single, inter-roll drive on one common end of the opposing rolls. Common designs comprise belt inter-roll drives, or single gearbox inter-roll drives. Inter-roll drive provide a differential speed between the opposing rolls of the roll milling machine to enhance grinding. In prior art machines, one of the opposing rolls is spring-loaded at each end for protection from tramp metal, rocks, or other foreign material in the feed of the material being ground. When fine grinding at high horsepowers, the forces of the single, inter-roll drive at the one common end of the rolls causes an uneven roll nip gap at a given end of the rolls. The forces of the single-ended, inter-roll drive cause the spring-loaded roll to move like a lever, with its drive-end bearing serving as the pivot. To date, no satisfactory solution for this problem has been proposed.

Further, prior art roll milling machines incorporate a belt-type inter-roll drive which provides the differential speed between the opposing rolls. A common drive consists of a drive sheave, a driven sheave, one or more idler sheaves, and a tension mechanism. A belt or belts gird the sheaves in what is referred to as a serpentine drive. The prior art tension mechanisms, however, are difficult to disassemble and reassemble, for the purposes of belt removal and replacement.

The foregoing illustrates limitations known to exist in present inter-roll drive milling machines. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a roll arrangement, for a milling machine, comprising: a frame; a first elongated roll rotatably mounted within the frame, the first roll having a first end and a second end, the first roll having first sheaves attached at each end; a second elongated roll rotatably mounted within the frame, the second roll having a first end and a second end, the second roll having second sheaves attached at each end; a first belted drive means coupled to the first and second roll first ends; and a second belted drive means coupled to the first and second roll second ends.

The foregoing and other aspects will become apparent from the following detailed description of the invention when considered in conjunction with the accompanying drawing Figures.

BRIEF DESCRIPTION OF THE DRAWING FIGURES

DETAILED DESCRIPTION

It is a purpose of this invention to set forth a roll arrangement for a milling machine which eliminates the levering of the spring-loaded roll, and prevents the excessive gaping between the coacting rolls. Particularly, it is an object of this invention to set forth a roll arrangement, for a milling machine, comprising a frame and a pair of elongated rolls wherein the rolls have shafts fixed thereto, and rotatably mounted to said frame; and first means supported by said frame, for biasingly constraining, and yieldably accommodating displacement of, one of said rolls in rolling engagement with the other thereof; and second means, coupled to said shafts, for effecting and maintaining a uniform, inter-rolling engaging force, between said rolls, throughout the full lengths thereof.

Figure 1:
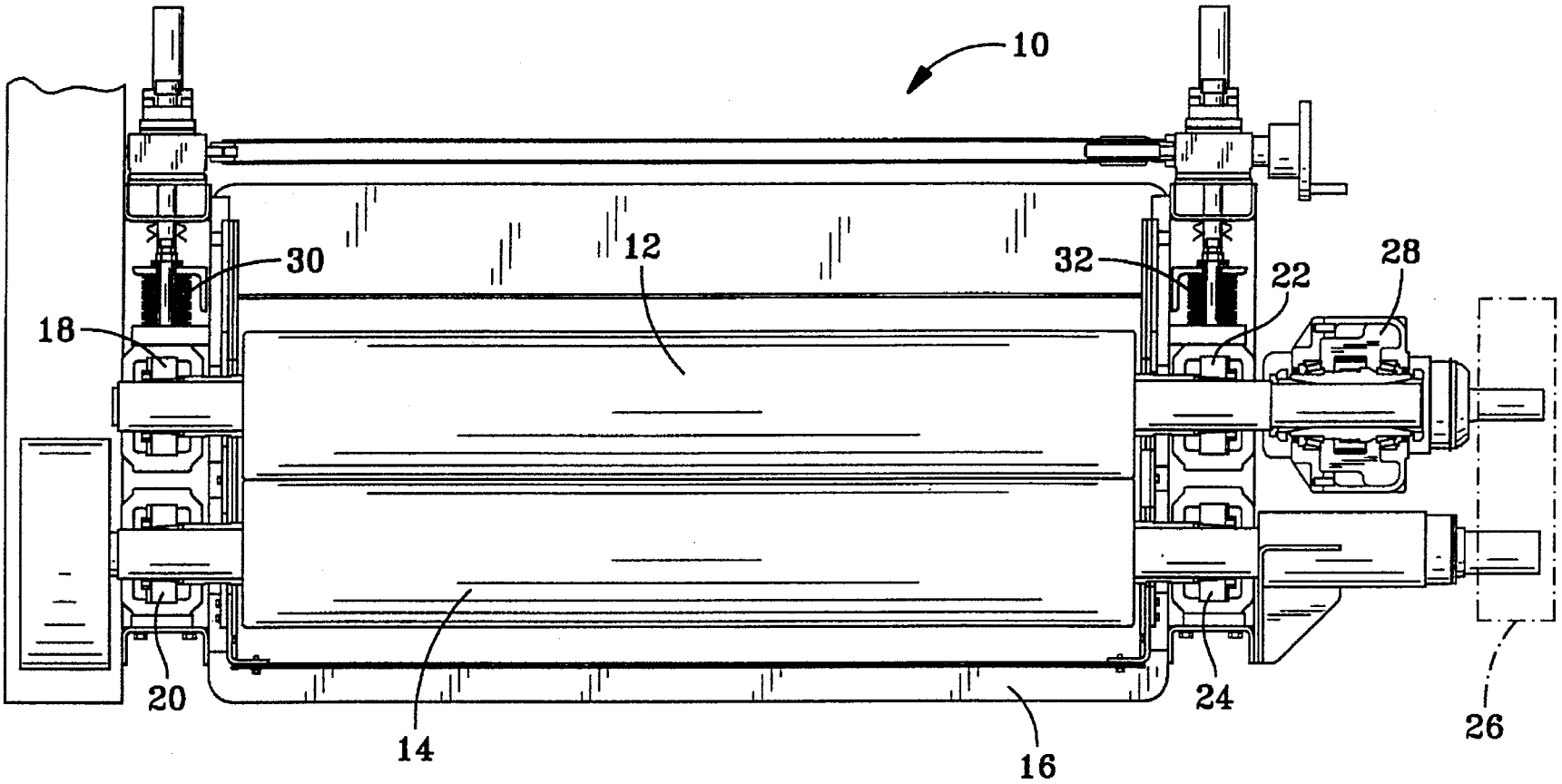
FIG. 1 (PRIOR ART)
FIG. 1 is a plan view of a portion of a milling machine showing a pair of coacting rollers, according to the prior art.

A portion 10 of a milling machine and a pair of coacting rolls 12 and 14 is shown in FIG. 1. Each roll 12, 14 is journalled in the machine frame 16, and the shafts thereof are mounted in bearings 18, 20, 22 and 24. At the right-hand end of the rolls 12, 14 (as viewed in FIG. 1) is an inter-roll drive 26, the same represented simply by dashed-line outlining. Inter-roll drive 26 can be a common belt-type drive. A single, gearbox, inter-roll drive 28 is mounted to roll 12 and drives both rolls 12, 14. Additionally, roll 12 is biasingly held against roll 14 by compression springs 30 and 32.

The inter-roll drive 26 maintains a constant force, between the rolls 12 and 14 at the right-hand end of the rolls. However, at the opposite ends of the rolls 12 and 14, there is no same force. Consequently, when the rolls must pass tramp metal, rocks, or other such foreign material, the springs 30 and 32 do not provide for a uniform, displacement gap.

Figure 2:
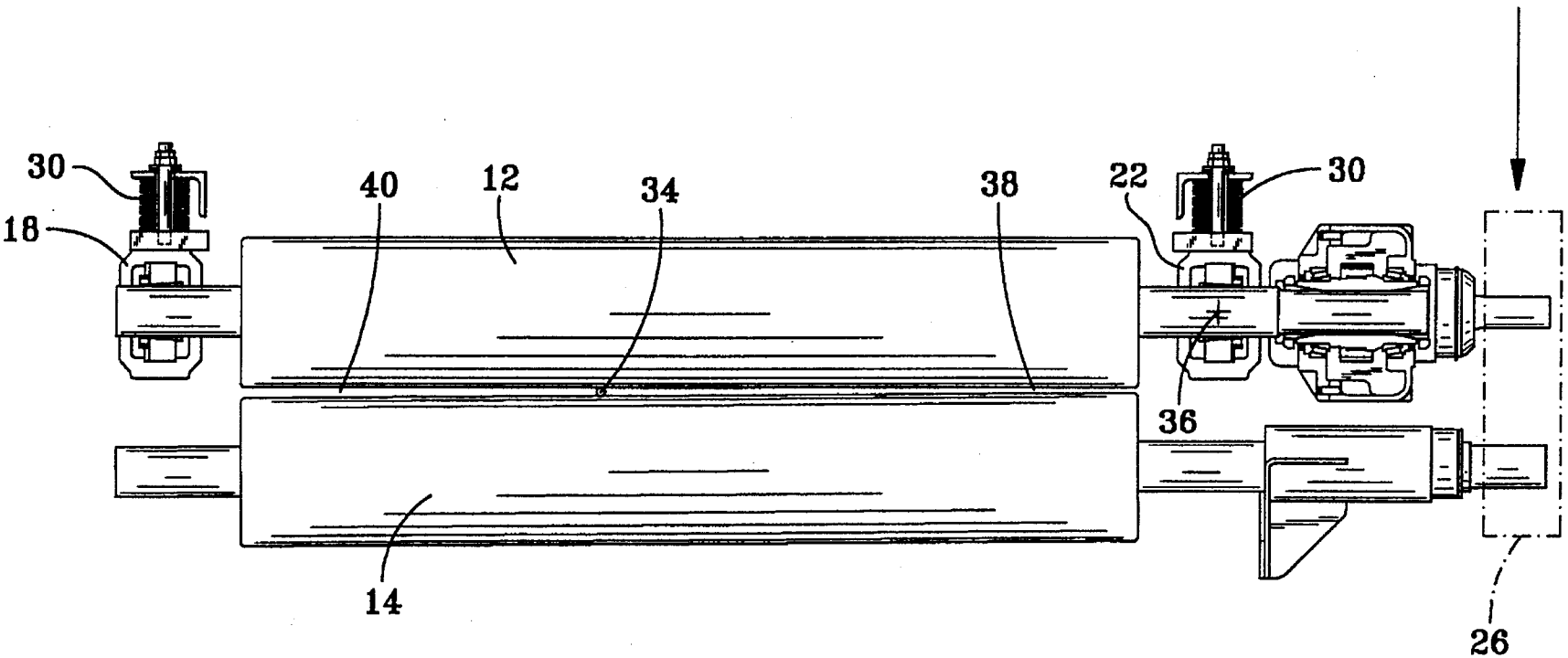
FIG. 2 (PRIOR ART)
FIG. 2 is a partial representation of the FIG. 1 illustration, the rollers having to accommodate a hard, foreign object therebetween.

FIG. 2 depicts what occurs when a foreign object is introduced between the rolls 12 and 14. Foreign object 34 causes the rolls to compress the springs 30 and 32. However, because the left-hand end (as viewed in FIG. 2) of the rolls 12, 14 are not constrained together by a drive mechanism, such as drive 26, the roll 12 is pivoted about the bearing 22, at its locus 36. While the right hand end of the rolls 12 and 14 are held to a minimum gaping 38, at the drive end, an unacceptable, excessive gaping 40 occurs toward the opposite ends of the rolls. Simply, spring 30 yields more than does spring 32.

Figure 3:
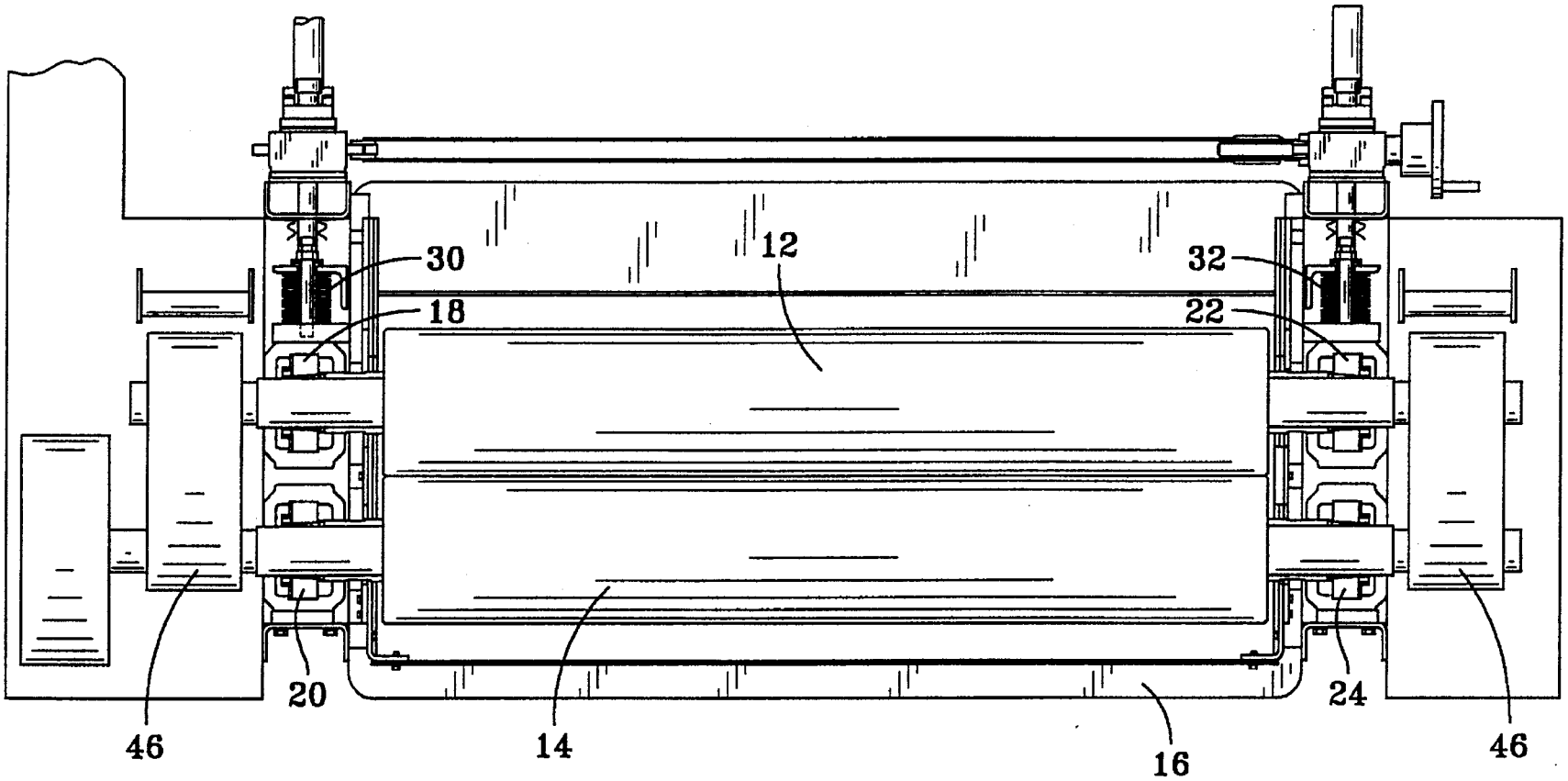
FIG. 3 is a plan view showing a roll arrangement for a milling machine according to one embodiment of the invention.
Figure 4:
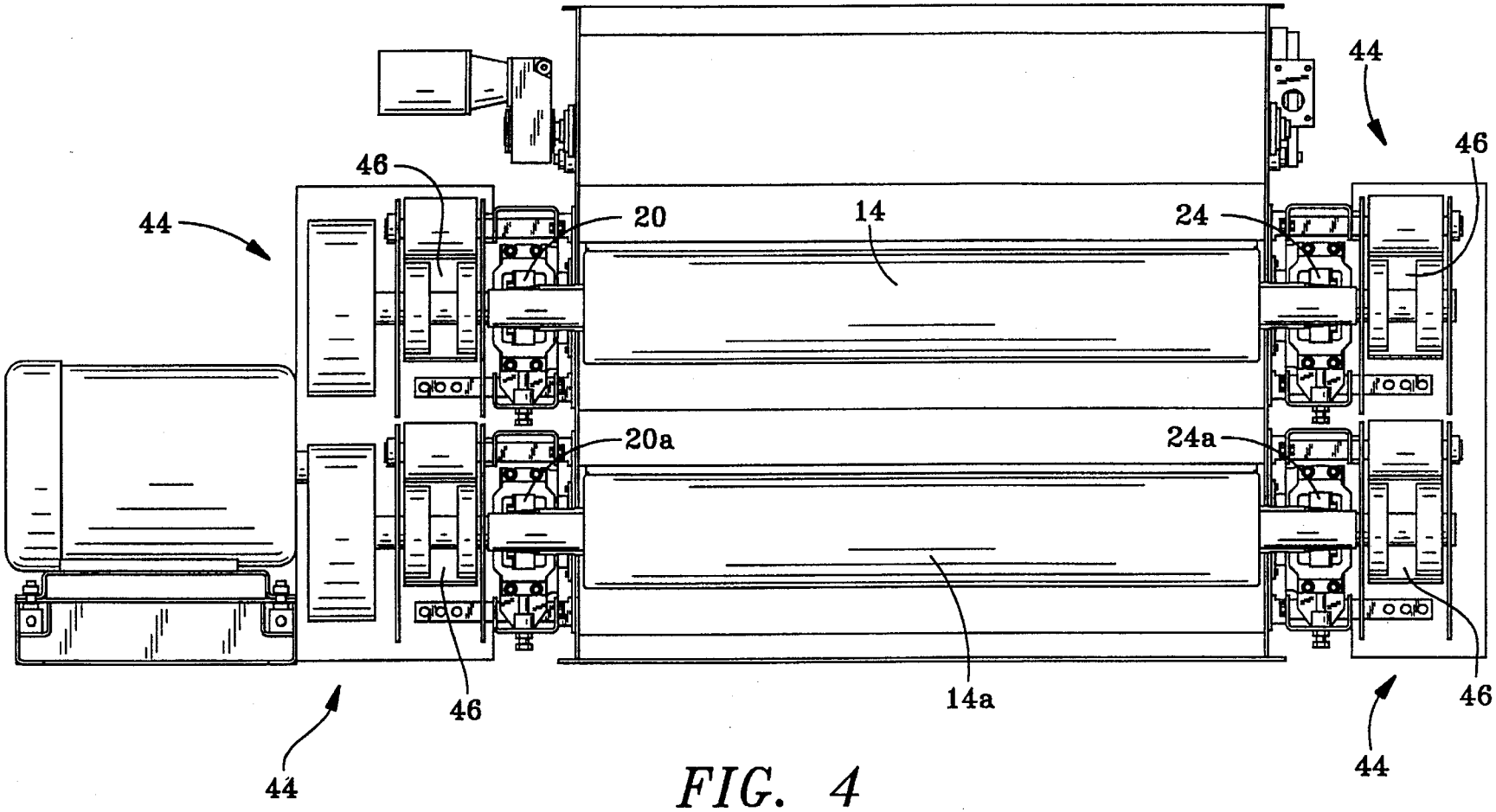
FIG. 4 is an elevational view of the embodiment of FIG. 3.
Figure 5:
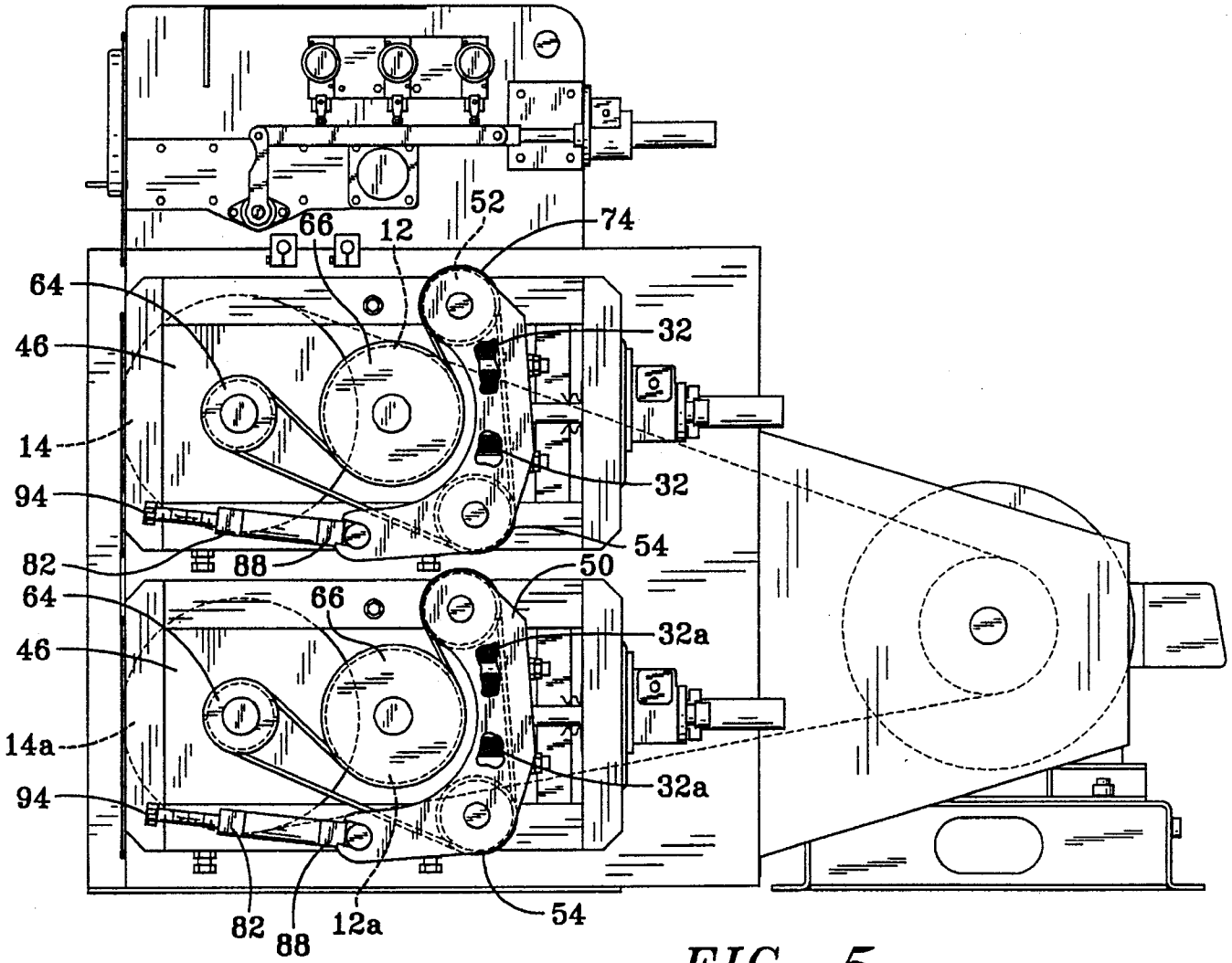
FIG. 5 is an elevational view of the novel inter-roll drive according to an embodiment thereof, as is employed at opposite ends of the rolls of FIGS. 3 and 4.
Figure 6:
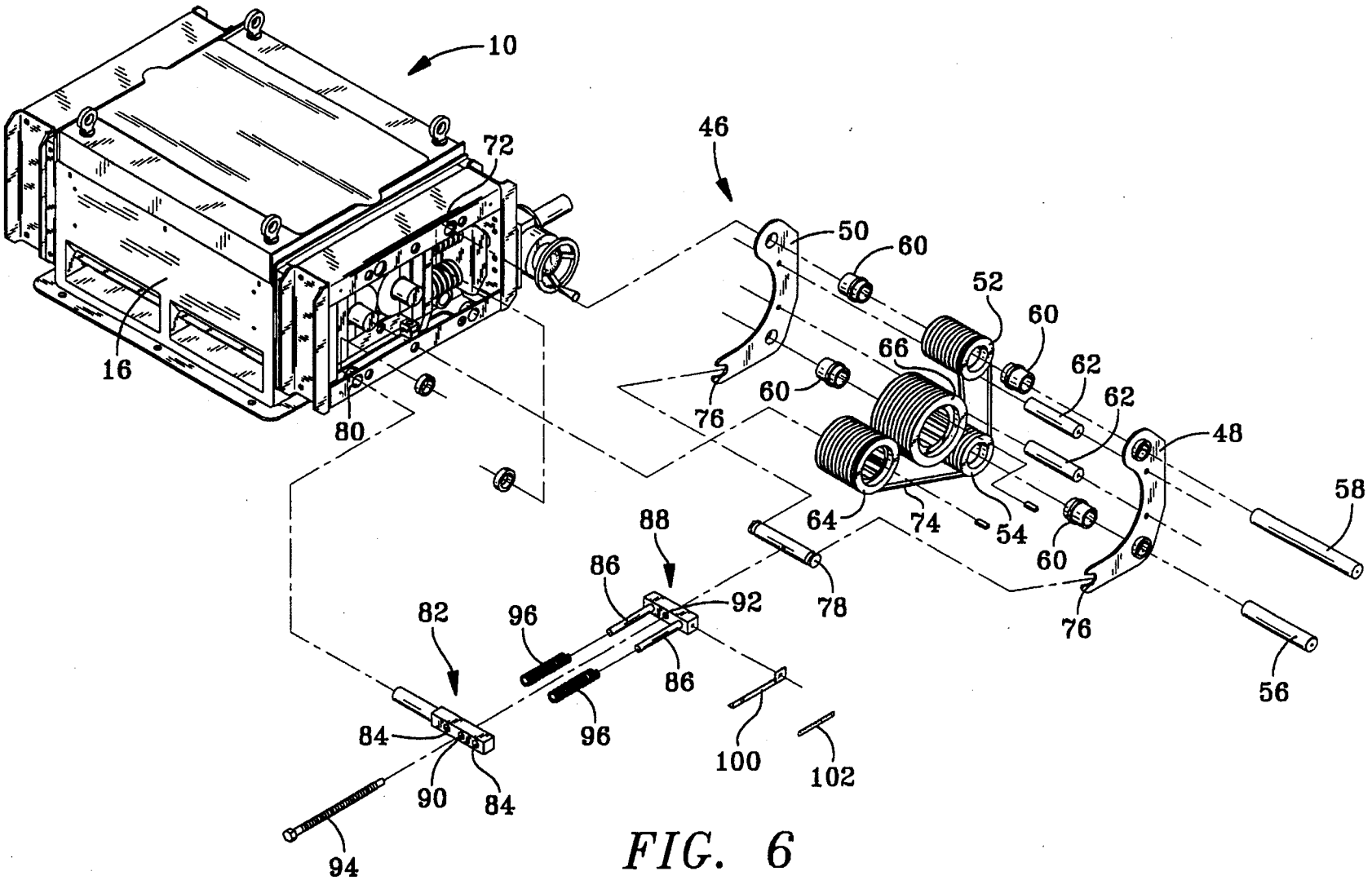
FIG. 6 is an exploded view of the inter-roll drive of FIG. 5.

FIGS. 3 and 4 depict plan and elevational views of a roll arrangement 44 which prevents uneven gaping between the rolls, and FIGS. 5 and 6 illustrate a novel, inter-roll drive therefor.

As shown in FIGS. 3 and 4, the novel roll arrangement 44 comprises means coupled to the shafts of the rolls 12 and 14, and **12*a* (shown in FIG. 5) and 14*a*, for effecting and maintaining a uniform, inter-rolling engaging force, between the rolls, throughout the full lengths of the rolls. At each end of the rolls 12, 14, 12***a* and 14*a* are inter-roll drives 46, of the belt-type in this embodiment. The rolls 12 and 12*a* are still biasingly held against the coacting rolls 14 and 14*a*, by springs 30 and 32 (and 30*a* and 32*a*), but the driving engagement of the roll shafts, at the opposite ends of the rolls prevents rolls 12 and 12*a* from pivoting about the bearings 22 and 22*a*. Whatever foreign material will be encountered by the rolls 12, 12*a*, 14 and 14*a*, the rolls 12 and 12*a* will displace from the rolls 14 and 14*a* to define a uniform gap along the length of the rolls. The dual-ended, inter-roll drives 46 maintain the uniform, inter-rolling engaging force between the rolls.

The inter-roll drive(s) 46, shown in FIGS. 5 and 6, comprises the usual serpentine arrangement of belting about sheaves. However, the same comprises novel means for facilitating removal and replacement of the belting, when necessary, without requiring complete disassembly of the drive for the purpose. In lieu of the belt drives 46 shown in FIGS. 3 through 7, two gearbox inter-roll drives can be used. Gearbox drives are typically used when higher horsepower is needed.

Inter-roll drive 46 comprises a pair of generally right-angularly formed brackets 48 and 50. A pair of idler sheaves 52 and 54 are journalled on shafts 56 and 58. The latter are held in the brackets 48 and 50 in bushings 60. Spacers 62 and their associated hardware are interposed between the brackets 48 and 50 to support the brackets and hold them apart. The roll sheaves 64 and 66, the former 64 being smaller in diameter than the latter 66, are coupled to their respective roll shafts 68 and 70. Idler shaft 58 is greater in length than shaft 56, as its inner end is journalled in an aperture 72 provided in the frame 16. Belting 74 wraps or girds the sheaves 52, 54, 64, and 66. Leading ends of the brackets 48 and 50 have slots 76 formed therein; the slots 76 receive therein the annularly grooved ends of a rod or pivot pin 78.

Sheaves 64 and 66 are relatively stable in positioning, for being mounted to the roll shafts therefor. However, because idler shaft 58 is journalled in the aperture 72, a counter-clockwise rotation of the brackets 48 and 50, with their mounted components, will tighten the belting 74. Conversely, if the brackets 48 and 50, and mounted components, are rotated in a clockwise direction, the belting will become slack and readily removable from the sheaves 52, 54, 64 and 66 for replacement.

The novel drive 46 includes means for tensioning the brackets 48 and 50 and biasingly holding them in a relatively counter-clockwise disposition, to keep the belting 74 tight. The same tensioning means also accommodates release of the tensioning, and rotation of the brackets 48 and 50 in the clockwise direction, to facilitate an effortless replacement of the belting 74, without requiring a major disassembly of the drive 46.

The frame 16 has, in a lower portion thereof, an aperture 80. Aperture 80 receives the dowel end of a first bar 82 rotatably therein. The bar 82 has a pair of boreholes 84 formed therein. Boreholes 84 slidably receive a pair of rods 86 which extend from a second bar 88. In addition, first bar 82 has a tapped hole 90 formed therein, and second bar 88 has an untapped hole 92 formed therein. A bolt 94 threaded through bar 82 and bar 88 via the hole 92 bears against the pivot pin or rod 78. Finally, compression springs 96 on rods 86, and between the bars 82 and 88 maintain an optimum pressure between the bars 82, 88. This tensioning means maintains the brackets 48 and 50 in a relatively counter-clockwise, belting-tightened position. However, by loosening the bolt 94, and allowing the tensioning arrangement to rotate in the clockwise direction, the belting 74 becomes loose on the sheaves and is easily removed and replaced. A nut 98 is provided on the bolt 94 for tightening the bolt in the desired tensioning position. Also, a scale holder 100 and its associated graduated scale 102, are mounted onto the second bar 88. These items offer a means of repositioning the tensioning arrangement.

Upon loosening bolt 94, the pressure on the rod or pivot 78 is relieved and, accordingly, it can then be extracted from the slots 76 in the brackets 48 and 50. With the tension relieved, the bars 82 and 88, and the incorporated springs 96, can be rotated on the journalled dowel-end of bar 82 and swung up out of the way, giving access to the rod or pivot pin 78.

Figure 7:
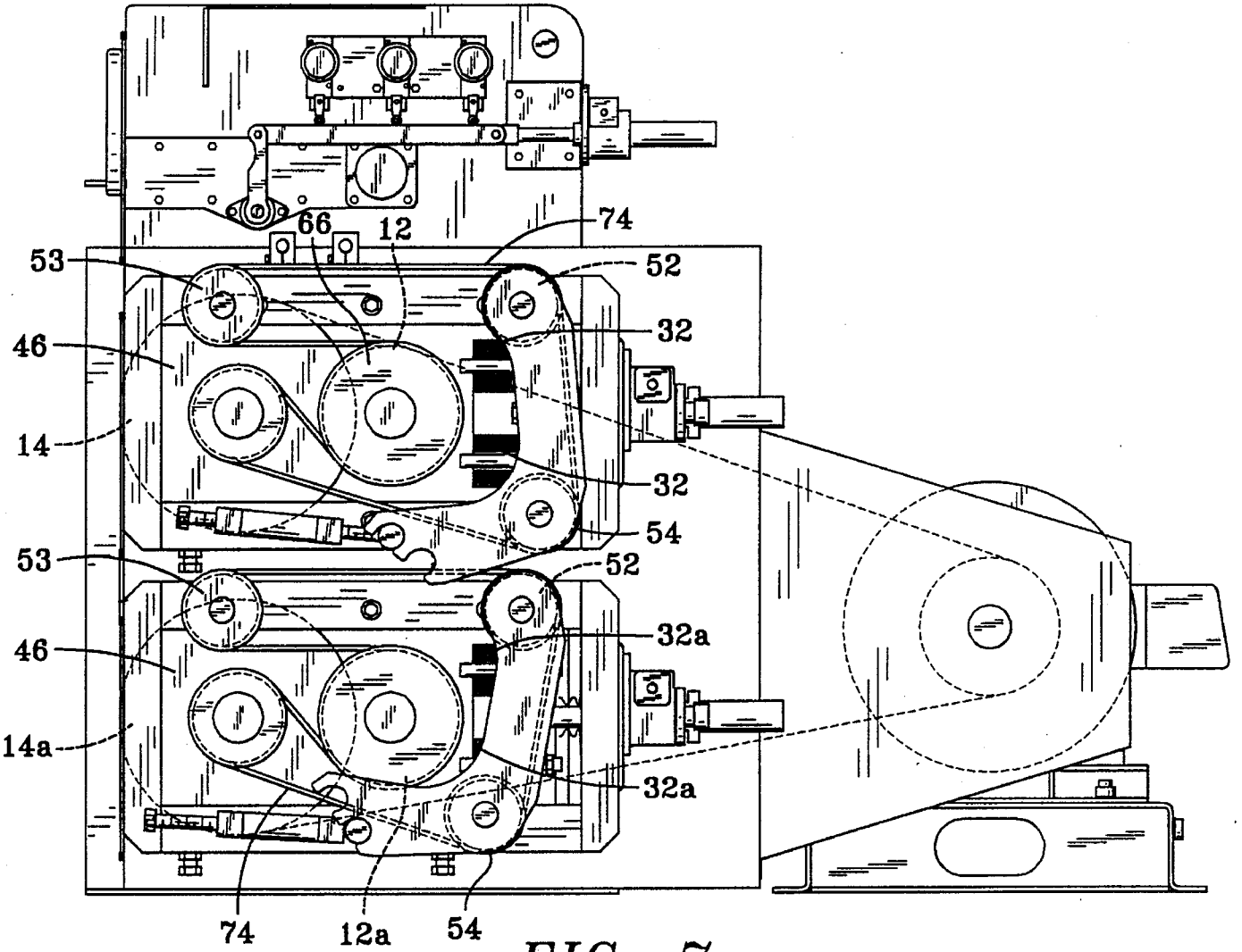
FIG. 7 is an elevational view of a preferred embodiment of the inter-roll drive of the present invention.

FIG. 7 shows a preferred embodiment of the belt inter-roll drive. A third idler sheave 53 is included to allow the belting 74 to wrap more then 180 degrees around the roll sheave 66. This causes the belt inter-roll drive to transmit more power to sheave 66.

Having described the invention, what is claimed is:

1. A roll arrangement, for a milling machine, comprising:

a frame;

a first elongated roll rotatably mounted within the frame, the first roll having a first end and a second end, the first roll having first sheaves attached at each end;

a second elongated roll rotatably mounted within the frame, the second roll having a first end and a second end, the second roll having second sheaves attached at each end;

a first drive means coupled to the first and second roll first ends; and a second drive means coupled to the first and second roll second ends.

2. The roll arrangement according to claim 1, further comprising:

a means for biasing the first roll towards the second roll.

3. The roll arrangement according to claim 1, wherein the first and second drive means are belted drive means.

4. The roll arrangement according to claim 3, wherein the first and second belted drive means each include a plurality of idler sheaves rotatable mounted within the frame and a drive belt, the first and second sheaves and the idler sheaves being configured such that the first roll rotates in an opposite direction to the second roll and each drive belt engages more than half the circumference of the first sheave and the second sheave.

5. The roll arrangement according to claim 4, wherein the number of idler sheaves for each drive means is three and each belt passes around the three idler sheaves, then the first sheave, then the second sheave.

6. The roll arrangement according to claim 3, wherein the diameter of the first sheave is greater than the diameter of the second sheave.

7. The roll arrangement according to claim 1, wherein the first and second drive means are gear drive means.

8. A roll arrangement, for a milling machine, comprising:

a frame;

a first elongated roll rotatably mounted within the frame, the first roll having a first end and a second end, the first roll having first sheaves attached at each end;

a second elongated roll rotatably mounted within the frame, the second roll having a first end and a second end, the second roll having second sheaves attached at each end, the diameter of the first sheave being greater than the diameter of the second sheave;

a means for biasing the first roll towards the second roll;

a first belted drive means coupled to the first and second roll first ends; and a second belted drive means coupled to the first and second roll second ends, the first and second belted drive means each including a drive belt, each drive belt engaging more than half the circumference of the first sheave and the second sheave.

9. A roll arrangement, for a milling machine, comprising:

a frame;

a first elongated roll rotatably mounted within the frame, the first roll having a first end and a second end, the first roll having first sheaves attached at each end;

a second elongated roll rotatably mounted within the frame, the second roll having a first end and a second end, the second roll having second sheaves attached at each end;

a first inter-roll drive means coupled to the first and second roll first ends;

a second inter-roll drive means coupled to the first and second roll second ends; and a drive means, operably connected to the first inter-roll drive means, for providing drive power to the first inter-roll drive means, power being provided through the first roll to the second inter-roll drive means.

* * * * *